United States Patent [19]

Rich

[11] Patent Number: 4,469,391

[45] Date of Patent: Sep. 4, 1984

[54] COAXIAL CABLE CONNECTOR

[75] Inventor: Donald S. Rich, Long Valley, N.J.

[73] Assignee: Thomas & Betts Corporation, Raritan, N.J.

[21] Appl. No.: 310,827

[22] Filed: Oct. 13, 1981

[51] Int. Cl.[3] ..... H01R 4/02

[52] U.S. Cl. ..... 339/97 R; 339/102 R

[58] Field of Search ..... 339/97–99, 339/177 R, 177 E, 14 R, 103 R, 17 F, 17 C, 176 MF, 102 R

[56] References Cited

U.S. PATENT DOCUMENTS

| | | | |
|---|---|---|---|
| 2,590,886 | 4/1952 | Pederson | 173/322 |
| 2,856,592 | 10/1958 | Carlson | 339/21 |
| 3,299,391 | 1/1967 | Herrmann et al. | 339/14 |
| 3,324,421 | 6/1967 | Fujimoto | 333/9 |
| 3,328,747 | 6/1967 | Dover et al. | 339/97 |
| 3,543,222 | 11/1970 | Rheinfelder | 339/99 |
| 3,602,872 | 8/1971 | Braunstein | 339/97 R |
| 3,824,529 | 7/1974 | Dorrell | 339/99 |
| 3,848,955 | 11/1974 | Lockie et al. | 339/97 R |
| 3,976,351 | 8/1976 | Hopfe | 339/99 |
| 3,977,754 | 8/1976 | Brummans | 339/99 |
| 4,120,554 | 10/1978 | Bianchi et al. | 339/97 R |
| 4,266,842 | 5/1981 | Dillon, Jr. et al. | 339/97 P |
| 4,351,582 | 9/1982 | Emerson et al. | 339/97 P |

FOREIGN PATENT DOCUMENTS

| | | | |
|---|---|---|---|
| 1219029 | 1/1971 | United Kingdom | 339/97 R |

OTHER PUBLICATIONS

"Coaxial Tapping: Now Simple, and Sustaining" (p. numbered 5 and 6).

*Primary Examiner*—Eugene F. Desmond
*Assistant Examiner*—David L. Pirlot
*Attorney, Agent, or Firm*—Robert M. Rodrick; Salvatore J. Abbruzzese

[57] ABSTRACT

A connector for impedance-matched low capacitance connection to coaxial cable includes an electrically conductive housing having a pair of intersecting channels therein. A first channel receives the insulated conductor of a coaxial cable and the other channel seats an insulator which supports a contact element in the first channel for insulation-piercing of the insulated conductor. The housing is electrically connected to the shield of the coaxial cable and the transition through the contact element to ancillary apparatus is carried out with electrical equivalence to the coaxial cable environment.

22 Claims, 6 Drawing Figures

COAXIAL CABLE CONNECTOR

FIELD OF THE INVENTION

This invention relates generally to electrical connectors and assemblies and pertains more particularly to impedance-matched low capacitance connection of coaxial and like cable to digital data user devices, such as computer terminals.

BACKGROUND OF THE INVENTION

With the advent of the intra-office digital communication link intended to serve a plurality of computer terminals, for example, the Ethernet cable of the Xerox Corporation, need has arisen for an effective interconnecting device for the transition from cable of type having an insulated center conductor and encircling shield to the user device input terminal, typically a so-called N-series standard connector having a contact pin extending coaxially with a shield and protruding outwardly of insulation mutually spacing the shield and pin.

Were one simply to provide the pin with sharpened end configuration and drive the pin into the cable into piercing relation to the center conductor, the pin would also then engage the shield, providing ineffective connection wherein the cable conductor and shield are shorted together. In light of this situation, one known present approach to the problem looks to a cable preparation step wherein the shield is removed, prior to the piercing step, in the vicinity of the intended connection. The cable piercing can then be made without shorting possibility.

In an alternative approach, the contact pin is supported in a generally conical insulator and protrudes endwise therefrom. A substantial puncture is made through the shield into cable insulation with the pin thereupon engaging the conductor and being electrically insulated from the shield by the conical insulator. Some artisans note that this approach is ineffective, based on the tendency toward separation of the pin-conductor connection, absent bias maintaining their engagement. See, for example, U.S. Pat. No. 4,120,554, which employs plural opposed conical insulators, one carrying a contact pin, each insulator extensively puncturing the cable for maintaining biased engagement of the insulator-supported pin and the cable conductor.

Based on its extent of cable puncturing, such alternative approach may fairly be characterized as a solution with cable damaging potential, clearly involving a non-repeat connection. On the other hand, the comparative low cable damaging potential of the first-discussed approach has not seen realization in a non-customized connector product.

SUMMARY OF THE INVENTION

The present invention has as its object the provision of simplified practice for effecting impedance-matched connections to shielded cable.

It is a more particular object of the invention to provide for impedance-matched termination of or tapping into shielded cable without such cable puncture as would give rise to non-repeat connection and cable damage.

In attaining the foregoing and other objects, the invention provides a connector having a metal housing defining a pair of communicating, preferably mutually intersecting, channels, one adapted to receive the insulated conductor of a shielded cable and the other seating an insulator which supports a contact element with an insulation-piercing end portion in the intersection zone of the channels and with an opposed end portion accessible exteriorly of the housing for connection to an ancillary shielded connector. Means are provided for permitting the insulated center conductor to be forced into insulation-pierced relation with the contact element and for providing electrical continuity as between the cable shield and the connector housing. As the metal housing is connected to the cable shield and encompasses the insulated conductor throughout its course in the housing, as the housing-seated insulator circumscribes the contact element throughout its residence in the connector, and as the metal housing circumscribes the housing-seated insulator, shielded cable equivalence is found throughout the transition from the cable to ancillary apparatus, giving rise to impedance-matched low capacitance interconnection.

The foregoing and other objects and features of the invention will be further evident from the following detailed description of the preferred embodiment of a connector and assembly in accordance with the invention and from the drawings illustrating same, wherein like reference numerals identify like parts throughout.

DESCRIPTION OF THE PREFERRED EMBODIMENTS

Figure 1:
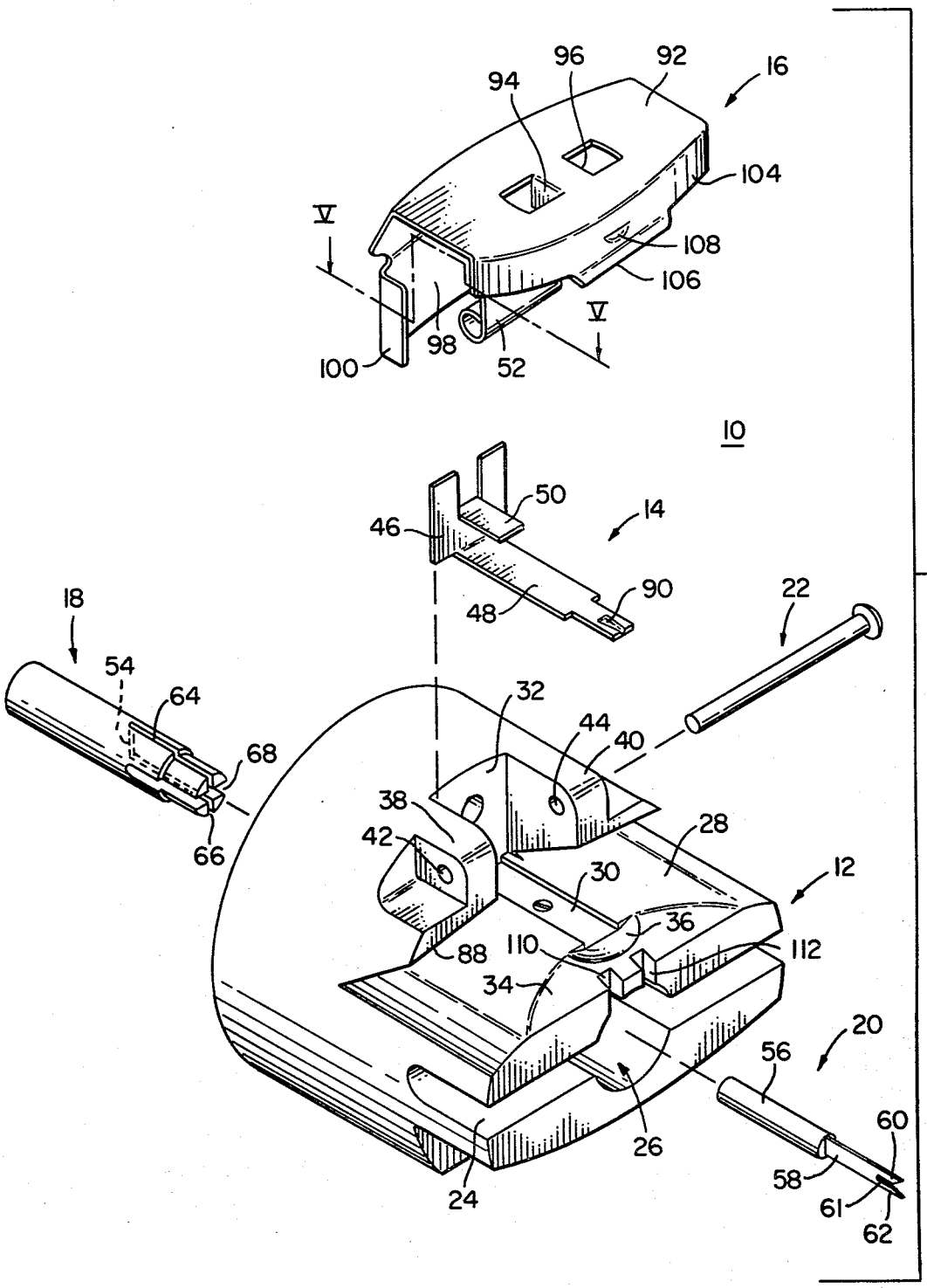
FIG. 1 is an exploded perspective view of component parts of the particularly preferred embodiment of a connector in accordance with the invention.

Returning to FIG. 1, connector 10 includes housing 12, spring insert 14 and cover 16, all constituted of electrically conductive material, insulator 18, contact element 20 and pin 22 adapted to secure cover 16 to housing 12 and provide rotational support for cover 16.

Housing 12 has intersecting channels 24 and 26 extending therethrough in mutually perpendicular communicating relation, channel 24 being adapted for the receipt of the insulated conductor of a coaxial cable assembly and channel 26 being adapted for the seating of insulator 18.

Support surface 28 is an outer surface of housing 12 and is thus accessible for placement of cable components thereon when cover 16 is in its open attitude (inoperative position) as in FIG. 1. Surface 28 has groove 30 running transversely therein from back wall 32 to tapered surface 34, which has undercut 36 formed therein at the end of groove 30. Shoulders 38 and 40 provide seating bores 42 and 44 for pin 22.

In assembling the component connector parts of FIG. 1, spring insert 14 is placed with upright member 46 thereof against back wall 32 and stem 48 in groove 30. Shelf 50 is thus situated below bores 42 and 44. Cover hinge 52 is then disposed atop shelf 50 and pin 22 is driven into bore 44, through hinge 52 and into bore 42, thus capturing insert 14 and supporting rotational movement of cover 16 relative to housing 12.

Contact element 20 is pre-assembled with insulator 18 by the insertion, into a rearward insulator bore (not shown), of contact element end portion 58. Opposite contact element end portion 56 is formed as a hollow cylinder of metal and frictionally seats in the insulator bore. Upon full insertion, contact element end portion 58 emerges through slot 54 and is seated in insulator 18, insulation-piercing teeth 60 and 62 being resident in slots 64 and 66 of insulator 18. Contact element slot 61 is thus disposed in end opening 68 of insulator 18. This subassembly is now inserted through the rearward side of housing 12 into channel 26, the component parts being so dimensioned that insulator 18 is frictionally captured in housing 12 with insulator end opening 68, and hence, contact element slot 61 resident in both channels 24 and 26, i.e., resident in the zone of intersection of the channels.

Figure 2:
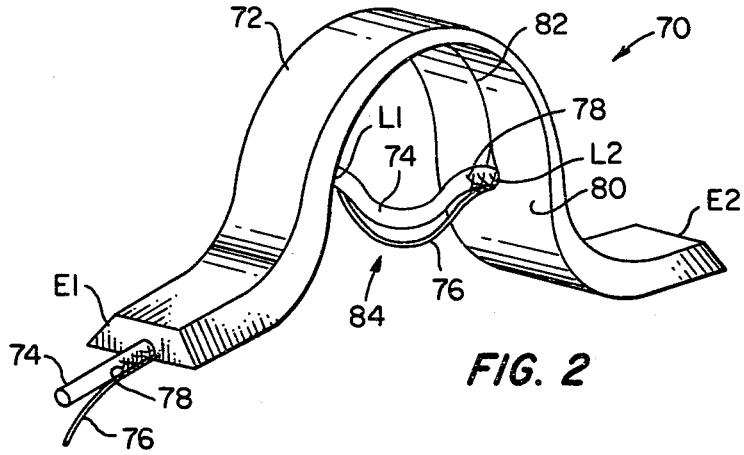
FIG. 2 is perspective view of a type of cable to be tapped into by the FIG. 1 connector, the cable being shown partly looped and with its insulated center conductor partly withdrawn from its protective casing.
Figure 3:
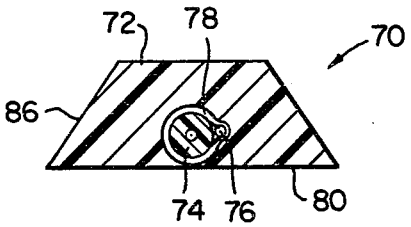
FIG. 3 is a typical cross-sectional view of the cable of FIG. 2.

Turning to FIGS. 2 and 3, a type of cable 70 is shown which may be tapped into or end-terminated with the FIG. 1 connector. Cable 70, the subject of commonly-assigned U.S. Pat. No. 4,404,425, issued on Sept. 13, 1983, includes a resilient protective casing 72 of electrically insulative material and a coaxial cable assembly therein comprising an insulated conductor 74, a drain wire 76 and an electrically conductive sheath 78. The sheath may be of conventional braided wire, but preferably is electrically conductive synthetic matter in the form of strands wrapped around insulated conductor 74.

As seen in FIG. 3, the coaxial cable assembly is disposed closely adjacent floor 80 of casing 72. By this practice one obtains both the benefit of increased protective resilient matter atop the coaxial cable assembly as against object movement thereon and the like and the benefit of ready separation of the assembly from casing 72 through the thin adjacent floor 80. Thus, by slight slitting of the floor with a blade, a removal avenue 82 is provided and the coaxial cable assembly may have an extent 84 extending spacedly outwardly of floor 80 as seen in FIG. 2. The coaxial cable assembly is thus contained within cable casing 72 from cable end E1 to cable location L1 and from opposite cable end E2 to cable location L2. Between locations L1 and L2, the coaxial cable assembly is exterior to casing 72 over extent 84.

Cable assembly 70 is manipulated to form a loop, as shown in FIG. 2, and coaxial cable assembly extent 84 is worked to remove sheath 78 therefrom, thus exposing insulated conductor 74 and drain wire 76.

Figure 4:
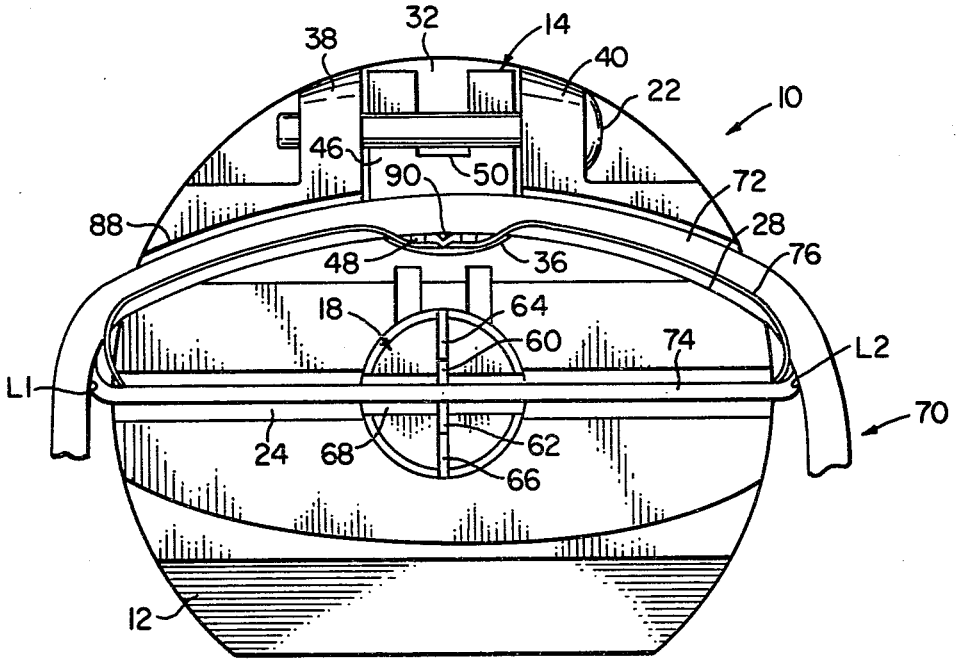
FIG. 4 is an enlarged front elevation of the FIG. 1 connector with the FIG. 2 cable positioned therein prior to interconnection, the connector cover being omitted to permit the enlargement of the showing.

Referring to FIG. 4, resilient casing 72 is dressed upon connector surface 28 with inboard cable assembly side edge 86 (FIG. 2) faired under tapered guide 88 (FIG. 1) of connector 10. Stem 48 of spring insert 14 is lifted and drain wire 76 slipped thereunder and captured as lance 90 of insert 14 reseats in undercut 36. The spring pressure of stem 48 biases drain wire 76 into engagement with the floor of groove 30, thereby electrically interconnecting the drain wire and housing 12 and hence placing housing 12 at electrical ground (shield) potential.

Insulated conductor 74 is dressed into channel 24, being routed fully therethrough, and through opening 68 (FIG. 1) of insulator 18 to be juxtaposed with insulation-piercing teeth 60 and 62. With the parts so assembled and since insulated conductor 74 is accessible exteriorly of channel 24, any suitable crimping device may be used to displace insulated conductor 74 into teeth 60 and 62 to provide for electrical connection of the cable conductor and the contact element.

Figure 5:
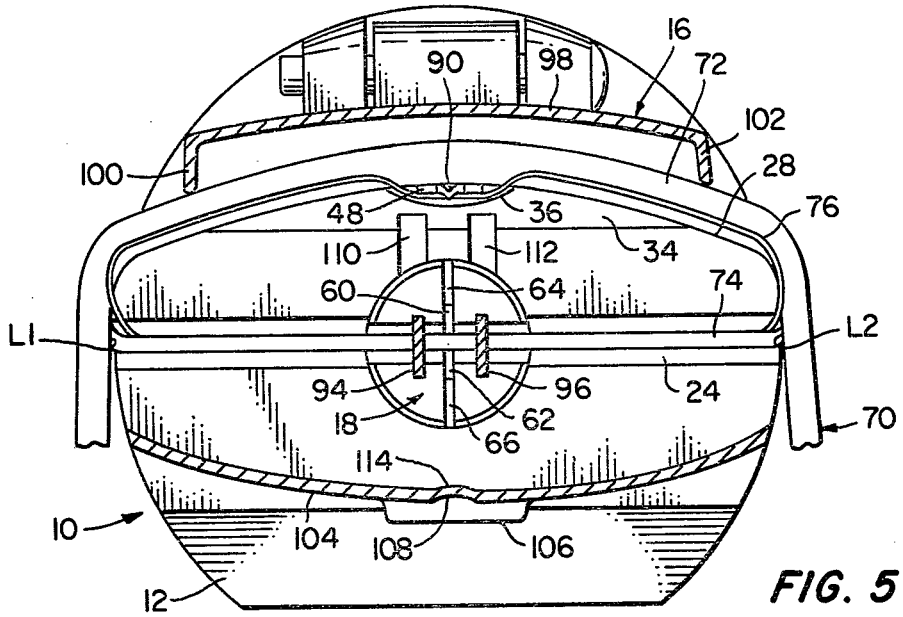
FIG. 5 is a further enlarged front elevation of the FIG. 1 connector following interconnection with the FIG. 2 cable, the connector cover being shown in operative position but, for clarity, in section as would correspond to its structure in plane V—V of FIG. 1.

In the preferred embodiment of the invention, such interconnection is effected by use of cover 16. Referring again to FIG. 1, the cover has a generally flat cap expanse 92 in which are formed inwardly directed lugs 94 and 96. Upright wall 98 defines hinge 52 at its lower end and has inwardly directed side arms 100 and 102 (FIG. 5). A further wall 104 extends downwardly of cap expanse 92 and includes tab 106. Tab 106 defines inwardly directed detent 108.

For purposes of clarity in showing the function of cover 16 in operative, i.e., closed, position relative to the remaining component parts of connector 10, FIG. 5 illustrates cover 16 in section as it would be seen from plane V—V of FIG. 1, however, with the cover rotated ninety degrees clockwise from its FIG. 1 inoperative position. In such cover operative position lugs 94 and 96 have passed through clearance openings 110 and 112 of surface 34 and have abutted insulated conductor 74, forcing same inwardly into electrical connection with teeth 60 and 62. Cover sidearms 100 and 102 have bitten into resilient casing 72, forcing same against housing 12 and providing strain-relief for cable 70. Upright 98 seats tightly upon casing 72. Detent 108 seats in recess 114 of housing 12, thus retaining the connector tightly closed upon the cable. The overall cover configuration is such that, with support surface 28, it defines a passage for travel of the cable casing and drain wire through the housing.

As will be seen, the lineal extent of casing 72 in connector 10 substantially exceeds the lineal extent of channel 24 therein. Insulated conductor 74, having the same length as casing 72 in the connector, will travel in sinuous or like loose manner through channel 24, being longer than the channel lineal extent. The connector accordingly both isolates the electrical connection of insulated conductor 74 to contact element 20 by applying strain relief to casing 72 and minimizes the possibility of strain at the connection by requiring surplus insulated conductor in channel 24.

The transition from cable 70 to contact element end portion 56 will be seen to involve continuous maintenance of shielding at ground potential and the presence of electrical insulation intervening such shielding and the electrically conductive members being interconnected therewithin. Thus as insulated conductor 74 emerges from casing 72 and hence sheath 78 at the right side (location L2) of FIG. 5, it is immediately circumscribed by housing 12 and cover expanse 92 (FIG. 1), both of which are at ground potential based upon connection of drain wire 76 and housing 12. As insulated conductor 74 travels throughout channel 24, this same situation applies through to location L1 at which the insulated conductor returns to casing 72 and the environment of sheath 78. While the sheath is typically cut away outside casing 72, drain wire 76 reenters casing 72 at location L1 placing the sheath leftwardly in casing 72 at ground potential. At the point of interconnection of the conductor with teeth 60 and 62 of contact element 20, cable insulation is again present and insulator 18 further bounds opening 68 (FIG. 1). Throughout its travel in housing 12, contact element 20 is spaced from housing 12 by insulator 18. This continuous shielding situation further applies in connection to ancillary apparatus, as is now discussed with reference to FIG. 6.

Figure 6:
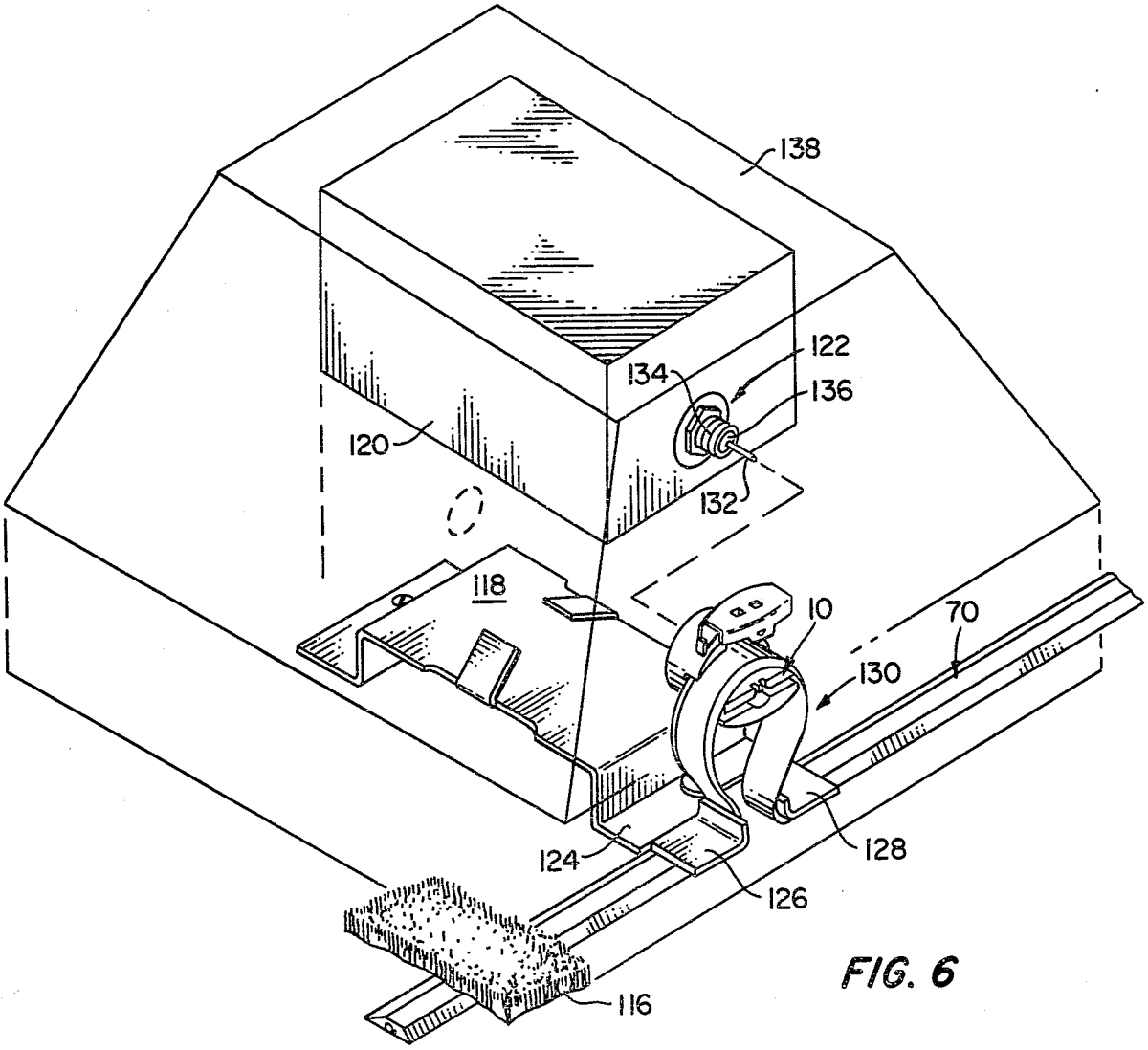
FIG. 6 is a perspective view of an application of the assembly of connector and cable in servicing a computer terminal.

FIG. 6 is an exploded view of an interconnection scheme wherein cable 70 of FIG. 2 is employed in a so-called office of the future application, i.e., serving a plurality of computer terminals. The cable is disposed, with a protective underlayer (not shown), which may be an adhesive tape, upon a floor beneath carpet tiles 116. A bracket 118 is secured to the floor to receive and support computer terminal transciever unit 120 or the like, which typically has an N-series standard input-output connector 122. Extending forwardly of bracket 118 and part thereof is flange 124, providing loop strain relief members 126 and 128 between which the cable loop 130 is formed. In practice, cable 70 may be laid on the floor, bracket 118 placed with members 126 and 128 atop the cable, loop 130 formed by drawing the cable upwardly beyond members 126 and 128 and bracket 118 then tightly secured to the floor. Connector 10 and cable loop 130 are then assembled, as above discussed and pin 132 of connector 122 is engaged with portion 56 (FIG. 1) of contact element 20 by pushing connector 10 toward terminal transciever 120. Upon such assembly, the shielded transition continues through shield 134 and insulation 136 of connector 122. A decorative pedestal 138 may now be placed over the assembled parts.

While the invention has been disclosed in a connector embodiment adapted for passage of a cable therethrough, so as to permit multiple impedance-matched taps to the cable, the invention of course contemplates terminating a cable in impedance-matched manner. In this case, one may use the particularly depicted connector simply with the end of the cable contained therein or otherwise construct a special purpose termination connector based on the foregoing teachings. These and other modifications to the particularly illustrated connector and interconnect scheme and practice will be evident to those skilled in the art and are within the scope of the invention. The disclosed and described preferred embodiment is this intended in an illustrative and not in a limiting sense. The true spirit and scope of the invention are set forth in the following claims.

What is claimed is:

1. An electrical connector for effecting connection to a cable having an electrically insulated conductor and a circumscribing shield, said connector comprising:

(a) a housing of electrically conductive material defining first and second channels accessible exteriorly of said housing and communicating with one another within said housing, said first channel being adapted for receiving said insulated conductor;

(b) an electrical contact element having first and second opposed end portions, such first end portion being of insulation-piercing type;

(c) an electrical insulator seated in said second channel and circumscribingly supporting said contact element to dispose said first end portion thereof in said first channel for engagement with said conductor and to dispose said second end portion to be accessible exteriorly of said housing;

(d) interconnect means for electrically interconnecting said shield to said housing; and (e) means movably supported by said housing for effecting displacement of said insulated conductor into said first end portion of said contact element to provide electrical connection therebetween.

2. The connector claimed in claim 1 wherein such movably supported means includes lug means for movement into said first channel and into abutment with said insulated conductor for effecting said displacement thereof.

3. The connector claimed in claim 1 wherein said housing includes a rotational support for such movably supported means.

4. The connector claimed in claim 1 wherein said cable further includes a drain wire, said interconnect means providing for electrical engagement of said drain wire with said housing to effect such electrical interconnection of said shield to said housing.

5. The connector claimed in claim 4 wherein said interconnect means includes a spring insert supported by said housing and adapted for receipt of said drain wire and for biasing said drain wire into such engagement with said housing.

6. The connector claimed in claim 1 wherein said insulator includes a cylindrical portion circumscribing such second end portion of said contact element.

7. The connector claimed in claim 6 wherein said second end portion of said contact element is a hollow cylinder.

8. An electrical connector for effecting connection to a cable having a protective casing releasably containing a coaxial cable assembly including an electrically insulated conductor and an electrically conductive sheath, said connector comprising:

(a) a housing of electrically conductive material defining first and second channels accessible exteriorly of said housing and intersecting one another within said housing, said first channel being adapted for receiving said insulated conductor, said housing further defining an exterior surface for supporting said protective casing;

(b) an electrical contact element having first and second opposed end portions, such first end portion being of insulation-piercing type;

(c) an electrical insulator seated in said second channel and circumscribingly supporting said contact element to dispose said first end portion thereof in said first channel for engagement with said conductor and to dispose said second end portion thereof to be accessible exteriorly of said housing;

(d) interconnect means for electrically interconnecting said sheath to said housing; and (e) cover means supported by said housing for movement between operative and inoperative positions and having (1) first means for engaging said protective casing in said operative position and applying strain relieving force thereto and (2) second means for engaging said insulated conductor in said operative position and forcing same into engagement with said first end portion of said contact element.

9. The connector claimed in claim 8 wherein said cable further includes a drain wire, said interconnect means providing for electrical engagement of said drain wire with said housing to effect such electrical interconnection of sheath to said housing.

10. The connector claimed in claim 8 wherein said insulator includes an end portion disposed in said first channel, such end portion defining an opening therethrough in registry with said first channel.

11. The connector claimed in claim 8 wherein said cover is configured to define with said exterior surface of said housing, in said operative position of said cover, a passage through said connector for said protective casing.

12. The connector claimed in claim 11 wherein said first channel provides for routing of said insulated conductor through said housing whereby tap connection may be made to said cable at locations intermediate ends thereof.

13. The connector claimed in claim 12 wherein the length of said passage exceeds the length of said first channel.

14. The connector claimed in claim 13 wherein said interconnect means includes a spring insert supported by said housing and adapted for receipt of said drain wire and for biasing said drain wire into such engagement with said housing.

15. The connector claimed in claim 8 wherein said insulator includes a cylindrical portion circumscribing such second end portion of said contact element.

16. The connector claimed in claim 15 wherein said second end portion of said contact element is a hollow cylinder.

17. An electrical assembly comprising:

(a) a cable having a protective casing containing at first and second spaced locations therealong a coaxial cable assembly including an insulated conductor and a conductive sheath, said coaxial cable assembly having an extent exterior to said casing between said first and second locations, said sheath being removed from said insulated conductor over at least a portion of said extent; and (b) a connector having (1) a housing of electrically conductive material defining first and second channels accessible exteriorly of said body and intersecting one another within said housing, said first channel having such coaxial cable assembly extent therein, said housing further defining a surface supporting said protective casing;

(2) an electrical contact element having first and second opposed end portions, such first end portion being of insulation-piercing type;

(3) an electrical insulator seated in said second channel and circumscribingly supporting said contact element, disposing such contact element first end portion in said first channel in engagement with said conductor and disposing such contact element second end portion to be accessible exteriorly of said housing; and (4) interconnect means electrically interconnecting said sheath to said body.

18. The electrical assembly claimed in claim 17 wherein said connector further includes cover means supported by said housing and having first means engaging said protective casing and applying strain relieving force thereto and second means engaging said insulated conductor and maintain same in electrical engagement with said first end portion of said contact element.

19. The electrical assembly claimed in claim 17 wherein ends of said cable are disposed on a substrate, said assembly further including a support bracket having spaced strained relief members adapted to securely engage said cable with said substrate, said cable defining a looped cable portion between said strain relief members inclusive of said first and second cable locations.

20. The electrical assembly claimed in claim 17 wherein said cable further includes a drain wire, said interconnection means providing for electrical engagement of said drain wire with said housing to effect such electrical interconnection of said sheath to said housing.

21. The electrical assembly claimed in claimed 20 wherein said interconnect means includes a spring insert supported by said housing and biasing said drain wire into such engagement with said housing.

22. An electrical connector for effecting connection to a cable having an electrically insulated conductor, a circumscribing shield and a drain wire, said connector comprising:

(a) a housing of electrically conductive material defining first and second channels accessible exteriorly of said housing and communicating with one another within said housing, said first channel being adapted for receiving said insulated conductor;

(b) an electrical contact element having first and second opposed end portions, such first end portion being of insulation-piercing type;

(c) an electrical insulator seated in said second channel and circumscribingly supporting said contact element to dispose said first end portion thereof in said first channel for engagement with said conductor and to dispose said second end portion to be accessible exteriorly of said housing; and (d) interconnect means for electrically interconnecting said shield to said housing including a spring insert supported by said housing and adapted for receipt of said drain wire and for biasing said drain wire into engagement with said housing.

* * * * *